US011537086B2

(12) United States Patent
Zhao et al.

(10) Patent No.: US 11,537,086 B2
(45) Date of Patent: Dec. 27, 2022

(54) PULSAR BASED TIMING SYNCHRONIZATION METHOD AND SYSTEM

(71) Applicants: University of Tennessee Research Foundation, Knoxville, TN (US); UT-Battelle, LLC, Oak Ridge, TN (US)

(72) Inventors: Jiecheng Zhao, Knoxville, TN (US); Yilu Liu, Knoxville, TN (US); Yong Liu, Knoxville, TN (US); Peter Louis Fuhr, Knoxville, TN (US); Tom King, Knoxville, TN (US); He Yin, Knoxville, TN (US); Lingwei Zhan, Knoxville, TN (US); Marissa Morales-Rodriguez, Knoxville, TN (US); Wenxuan Yao, Knoxville, TN (US)

(73) Assignees: University of Tennessee Research Foundation, Knoxville, TN (US); UT-Battelle, LLC, Oak Ridge, TN (US)

( * ) Notice: Subject to any disclaimer, the term of this patent is extended or adjusted under 35 U.S.C. 154(b) by 912 days.

(21) Appl. No.: 16/397,687

(22) Filed: Apr. 29, 2019

(65) Prior Publication Data

US 2019/0332067 A1 Oct. 31, 2019

Related U.S. Application Data

(60) Provisional application No. 62/663,680, filed on Apr. 27, 2018.

(51) Int. Cl.
*G04G 7/00* (2006.01)
*G04F 5/00* (2006.01)

(52) U.S. Cl.
CPC ..... *G04G 7/00* (2013.01); *G04F 5/00* (2013.01)

(58) Field of Classification Search
CPC ..... G04G 7/00; G04F 5/00; G04F 5/16; H04J 3/0688

(Continued)

(56) References Cited

U.S. PATENT DOCUMENTS 9,484,980 B1 * 11/2016 Mitchell, Jr. ..... G04F 5/16
2007/0093226 A1 * 4/2007 Foltyn ..... G01V 1/26 455/265

(Continued)

FOREIGN PATENT DOCUMENTS

CN 101561282 B 12/2010
CN 102175246 B 3/2013

(Continued)

OTHER PUBLICATIONS

T. Neagoe, V. Cristea and L. Banica, "NTP versus PTP in Com puter Networks Clock Synchronization," 2006 IEEE International Symposium on Industrial Electronics, 2006, pp. 317-362, doi: 10.1109/ISIE.2006.295613. (Year: 2006).*

(Continued)

*Primary Examiner* — Edwin A. Leon
*Assistant Examiner* — Kevin Andrew Johnston
(74) *Attorney, Agent, or Firm* — Jenkins, Wilson, Taylor & Hunt, P.A.

(57) ABSTRACT

A pulsar based timing synchronization method and system are disclosed. In one example, a method includes receiving, by a pulsar signal receiver device, a pulse signal emitted from one or more celestial objects and processing, by the pulsar signal receiver device, the pulse signal to discipline a local clock to determine an accurate time output. The method also includes generating, by the pulsar signal (Continued)

receiver device, a timing synchronization signal based on the determined accurate time output. The method further includes providing, by the pulsar signal receiver device, the timing synchronization signal to at least one of a local power system device and a timing distribution network server.

18 Claims, 5 Drawing Sheets

(58) Field of Classification Search
USPC ..... 368/46
See application file for complete search history.

(56) References Cited

U.S. PATENT DOCUMENTS

2009/0018762 A1* 1/2009 Sheikh ..... G01S 11/12 701/513
2009/0273517 A1* 11/2009 Thiesen ..... H01Q 21/065 342/372
2016/0198245 A1* 7/2016 Rhoads ..... G01R 29/18 340/870.02
2017/0060101 A1* 3/2017 Abbott ..... G06F 1/14

FOREIGN PATENT DOCUMENTS

CN 105376044 A * 3/2016
CN 106403930 A * 2/2017 ..... G01C 21/025
CN 104819719 B 6/2017
JP 2014163685 A * 9/2014

OTHER PUBLICATIONS

Becker et al. (2018) "Pulsar Timing and Its Application for Navigation and Gravitational Wave Detection," Space Science Reviews, vol. 214, No. 30, pp. 1-25.
Foster et al. (1990) "Constructing a Pulsar Timing Array," The Astrophysical Journal, vol. 361, pp. 300-308.
Kramer et al. (2013) "The European Pulsar Timing Array and the Large European Array for Pulsars", Classical and Quantum Gravity, vol. 30, 224009, pp. 1-13.
Manchester et al. (2013a) "The Parkes Pulsar Timing Array Project," Publications of the Astronomical Society of Australia (PASA), vol. 30, e017, pp. 1-31, doi:10.1017/pasa.2012.017.
Manchester (2013b) "The International Pulsar Timing Array," Classical and Quantum Gravity, vol. 30, 224010, pp. 1-12.
Taylor (1992) "Pulsar timing and relativistic gravity," Mathematical, physical and engineering sciences, 341, pp. 117-134.

* cited by examiner

PULSAR BASED TIMING SYNCHRONIZATION METHOD AND SYSTEM

CROSS-REFERENCE TO RELATED APPLICATIONS

This application claims benefit of U.S. Provisional Patent Application Ser. No. 62/663,680, filed Apr. 27, 2018, which is herein incorporated by reference in its entirety.

STATEMENT OF GOVERNMENT SUPPORT

This invention was made with government support under federal grant number NSF EEC 1041877 awarded by the National Science Foundation. The government has certain rights in the invention.

TECHNICAL FIELD

In accordance with some embodiments, the presently disclosed subject matter provides a system and method for providing an accurate timing synchronization signal using a pulsar signal receiver device.

BACKGROUND

The modern electric power grid relies on precise timing synchronization for conducting accurate measurements, state estimation, protection and control. A phasor measurement unit (PMU), among other synchrometrology devices, relies greatly on accurate timing in order to generate synchronized data for a wide area monitoring, protection, and control (WAMPC) system. Other devices, such as traveling wave fault detection devices, differential relays, power quality meters, and digital fault recorders also require highly accurate timing information.

As such, a reliable and resilient precision timing source is a critical component for an electrical power system. At present, a Global Navigation Satellite System (GNSS), such as a Global Positioning System (GPS), typically serves as the main timing source for most power systems. For example, in the GNSS system, atomic clocks on GNSS satellites are configured to generate accurate timing synchronization signals. The timing synchronization signals are subsequently transmitted from the GNSS satellites to the GPS receivers. Using at least four GNSS satellites, a GPS receiver is able to obtain its own geographical coordinates and an accurate time.

Moreover, electrical power system devices can obtain synchronous timing synchronization signals either directly from a GNSS receiver or from a timing distribution system that is synchronized to and disciplined by the GNSS. The GNSS, however, is susceptible to intentional and unintentional interference due to its low power signal propagation. Furthermore, the GNSS is typically the only timing source of a power system (i.e., without a backup), thereby reducing the overall reliability of the system.

Thus, there currently exists a need in the art for an improved system and method for providing accurate timing synchronization signals using a pulsar signal receiver device.

SUMMARY

A pulsar based timing synchronization method and system are disclosed. In some embodiments, the method includes receiving, by a pulsar signal receiver device, a pulse signal emitted from one or more celestial objects and processing, by the pulsar signal receiver device, the pulse signal to discipline a local clock to determine an accurate time output. The method also includes generating, by the pulsar signal receiver device, a timing synchronization signal based on the determined accurate time output. The method further includes providing, by the pulsar signal receiver device, the timing synchronization signal to at least one of a local power system device and a timing distribution network server.

In some embodiments, the subject matter described herein also includes a system comprising a timing distribution network server and a pulsar signal receiver device. The timing distribution network server is communicatively connected to a plurality of remote power system devices. The pulsar signal receiver device is configured to receive a pulse signal emitted from one or more celestial objects, process the pulse signal to discipline a local clock to determine an accurate time output, generate a timing synchronization signal based on the determined accurate time output, and to provide the timing synchronization signal to the timing distribution network server.

The subject matter described herein may be implemented in hardware, software, firmware, or any combination thereof. As such, the terms "function" "node" or "engine" as used herein refer to hardware, which may also include software and/or firmware components, for implementing the feature being described. In one exemplary implementation, the subject matter described herein may be implemented using a non-transitory computer readable medium having stored thereon computer executable instructions that when executed by the processor of a computer control the computer to perform steps. Exemplary computer readable media suitable for implementing the subject matter described herein include non-transitory computer-readable media, such as disk memory devices, chip memory devices, programmable logic devices, and application specific integrated circuits. In addition, a computer readable medium that implements the subject matter described herein may be located on a single device or computing platform or may be distributed across multiple devices or computing platforms.

BRIEF DESCRIPTION OF THE DRAWINGS

Preferred embodiments of the subject matter described herein will now be explained with reference to the accompanying drawings, wherein like reference numerals represent like parts, of which.

DETAILED DESCRIPTION

Figure 1:
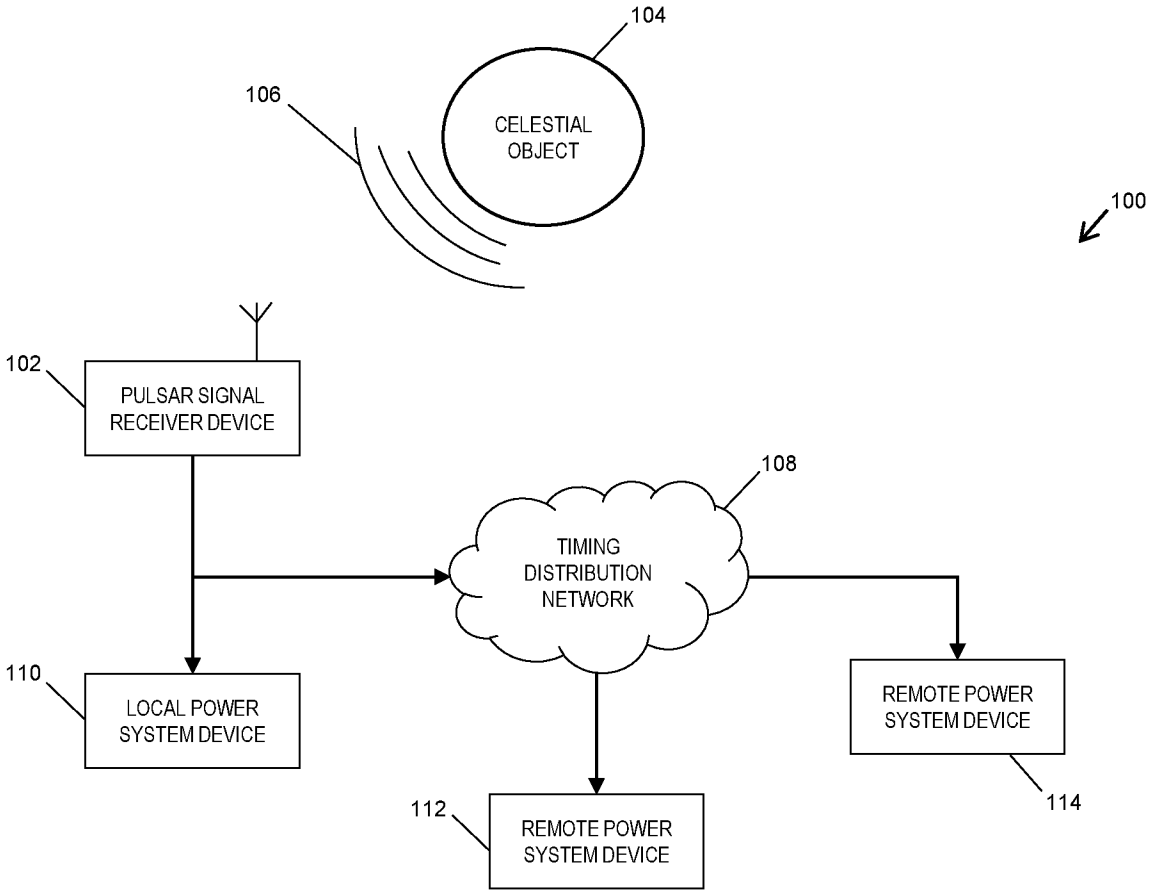
FIG. 1 is a block diagram of an exemplary system for providing a timing synchronization signal to an electrical power grid using sources of pulsed celestial radiation according to an embodiment of the subject matter described herein.

The presently disclosed subject matter will now be described more fully. The presently disclosed subject matter can, however, be embodied in different forms and should not be construed as limited to the embodiments set forth herein below and in the accompanying examples. Rather, these embodiments are provided so that this disclosure will be thorough and complete and to fully convey the scope of the embodiments to those skilled in the art.

Astronomical observations have revealed several different types of celestial objects that can produce accurate timing synchronization signal. Notably, a particularly accurate and stable timing synchronization signal source is generated by pulsars. A pulsar is essentially a compact, highly-magnetized neutron star that emits electromagnetic radiation as the pulsar rotates. The magnetic axis of a pulsar inclines to the rotation axis, which allows the pulsar to act like a cosmic "lighthouse" that emits a radio pulse signal. This emitted pulse signal can be detected and received by an antenna in instances where the signal beam is directed towards the Earth (e.g., at each pulsar rotation). The rotation periods of most pulsars range between 1 millisecond (ms) and 1 second (s). More importantly, the typical deviation of the pulsar rotation periods is less than $10^{-15}$ which make pulsars natural cosmic clocks that exhibit considerable precision and long-term stability. Because pulsars provide periodic and extremely stable signals, the pulsars can be used as a timing source in power system synchronization methods by providing accurate timing synchronization signals. In some embodiments, pulsar signals can be observed in the radio, optical, X-ray, and gamma-ray ranges of the electromagnetic spectrum.

The disclosed subject matter relates to a system and method for providing a synchronous timing mechanism by utilizing sources of pulsar celestial radiation. While the following is described in the context of exemplary electrical power systems (e.g., an electrical power grid system), any type of system requiring an accurate timing synchronization signal can be used without departing from the scope of the disclosed subject matter. In particular, the disclosed subject matter includes a pulsar signal receiver device that is configured for detecting and utilizing pulsed radiation signals generated by celestial sources. In some embodiments, the pulsar signal receiver device can be installed in a timing center, a power plant, a substation, a control center, or other location. Further, the pulse signals received by the pulsar signal receiver device can be used to generate a highly accurate timing synchronization signal to be used for power system management and synchronization. More specifically, the disclosed subject matter utilizes the accurate pulse signals from a pulsar or other celestial object to configure (e.g., discipline) a local clock in a pulsar signal receiver device and to generate an accurate timing synchronization signal with a desired timing interval and long term stability.

FIG. 1 illustrates a pulsar based timing synchronization system 100. In some embodiments, system 100 utilizes one or more sources of pulsed celestial radiation to synchronize the timing of system devices in an electrical power grid system according to an embodiment of the subject matter described herein. Although FIG. 1 depicts an electrical power grid system, any system that requires a timing synchronization signal can be used without deviating from the scope of the disclosed subject matter. In FIG. 1, system 100 includes a pulsar signal receiver device 102, a time distribution system server 108, a local power system device 110, and a plurality of remote power system devices 112-114. Although described in greater detail below and in FIG. 2, pulsar signal receiver device 102 may include a signal amplifier, a signal processor, a time residual correction engine, a local clock, and a timing interface module. Further, pulsar signal receiver device 102 may be configured detect a pulse signal 106 (e.g., a pulsed electromagnetic signal) generated by one or more celestial objects 104 (e.g., a pulsar). In some embodiments, the detected pulse signals are synchronously averaged by pulsar signal receiver device 102 at a predetermined period of the pulsar (or other celestial object). For example, the 1420 MHz (e.g., Hydrogen line frequency) component of pulse signal 106 may be used by pulsar signal receiver device 102 which aggregates the period of each pulse in a time window (e.g. 1 second) and converts the aggregation to another frequency, e.g., 100 Hz. As such, the random error of each period is therefore lowered by this averaging process. The averaged pulse signal periods are then used by pulsar signal receiver device 102 to discipline its local clock so as to generate a timing synchronization signal with high accuracy.

In some embodiments, pulsar signal receiver device 102 is configured to produce a timing synchronization signal that is based on the pulse signal received from and generated by celestial object 104. Although the following description describes celestial object 104 in FIG. 1 as a pulsar, pulsar signal receiver device 102 is configured to receive a pulse signal from any celestial source or body. As indicated above, a pulsar is a highly magnetized neutron star or white dwarf that rotates and emits a beam of electromagnetic radiation that can be detected by pulsar signal receiver device 102 after the signal beam is directed by the pulsar towards the Earth (e.g., at each rotation of the pulsar). Pulsar may radiate signals at radio, optical, X-ray and gamma-ray wavelengths. However, X-rays and gamma-rays are difficult to detect by devices on the Earth's surface due to the radiation absorption that occurs due to the planet's atmosphere. Similarly, optical wavelengths are also difficult to detect at the Earth's surface due to the strong optical disturbances produced by solar light energy. For at least these reasons, a radio signal produced by a pulsar is the preferred wavelength signal for conducting pulsar detection and timing by pulsar signal receiver device 102.

In some embodiments, a set or group comprising a plurality of pulsars can be used by system 100 in order to increase the accuracy and reliability of the timing synchronization. Since the rotation period of each pulsar is unique, pulse signals from different pulsars can be distinguished. For example, a set of pulsars with periods of millisecond, e.g., called a pulsar timing array (PTA), can be used by system 100 as the accurate timing source. Each pulsar in a PTA is observed by one or more antenna. The specified frequency, e.g. 1420 MHz, of each pulsar signal is extracted and averaged to a selected frequency, e.g. 100 Hz. Notably, the extracted frequency component of each pulsar can be different, but the frequency that it is converted to (decimated to) should be the same. The averaged periods of each pulsar are compared and averaged with specified weight to form the final averaged signal periods, which are used to discipline a local clock. The weight of each pulsar can be determined by comparing individually with a time reference, such as a highly accurate atomic clock.

After receiving a pulse signal from celestial object 104, pulsar signal receiver device 102 is configured to generate a timing synchronization signal. Details regarding the internal components of pulsar signal receiver device 102 and the generation of the timing synchronization signal are described in FIG. 2 and in the description below. Notably, pulsar signal receiver device 102 is configured to distribute the timing synchronization signal to one or more elements in system 100. In some embodiments, the timing synchronization signal generated by pulsar signal receiver device 102 can be provided to a local power system device 110. Further, the timing synchronization signal can be forwarded by pulsar signal receiver device 102 to a time distribution network server 108, which is responsible for providing the timing synchronization signal to a plurality of remote power system devices 112-114. For example, timing distribution network server 108 can be configured to distribute an accurate timing synchronization signal to remote power substations and other power system locations that require the timing synchronization signal. In the example depicted in FIG. 1, power system devices 110-114 may include phasor measurement units, out-of-step relays, digital fault recorder, power quality meters, travelling-wave based fault locator, and the like. Notably, power system devices 110-114 can be configured to utilize the timing synchronization signal produced by pulsar signal receiver device 102 to conduct power system synchronous monitoring, protection, and control functions in the electrical power grid system.

Figure 2:
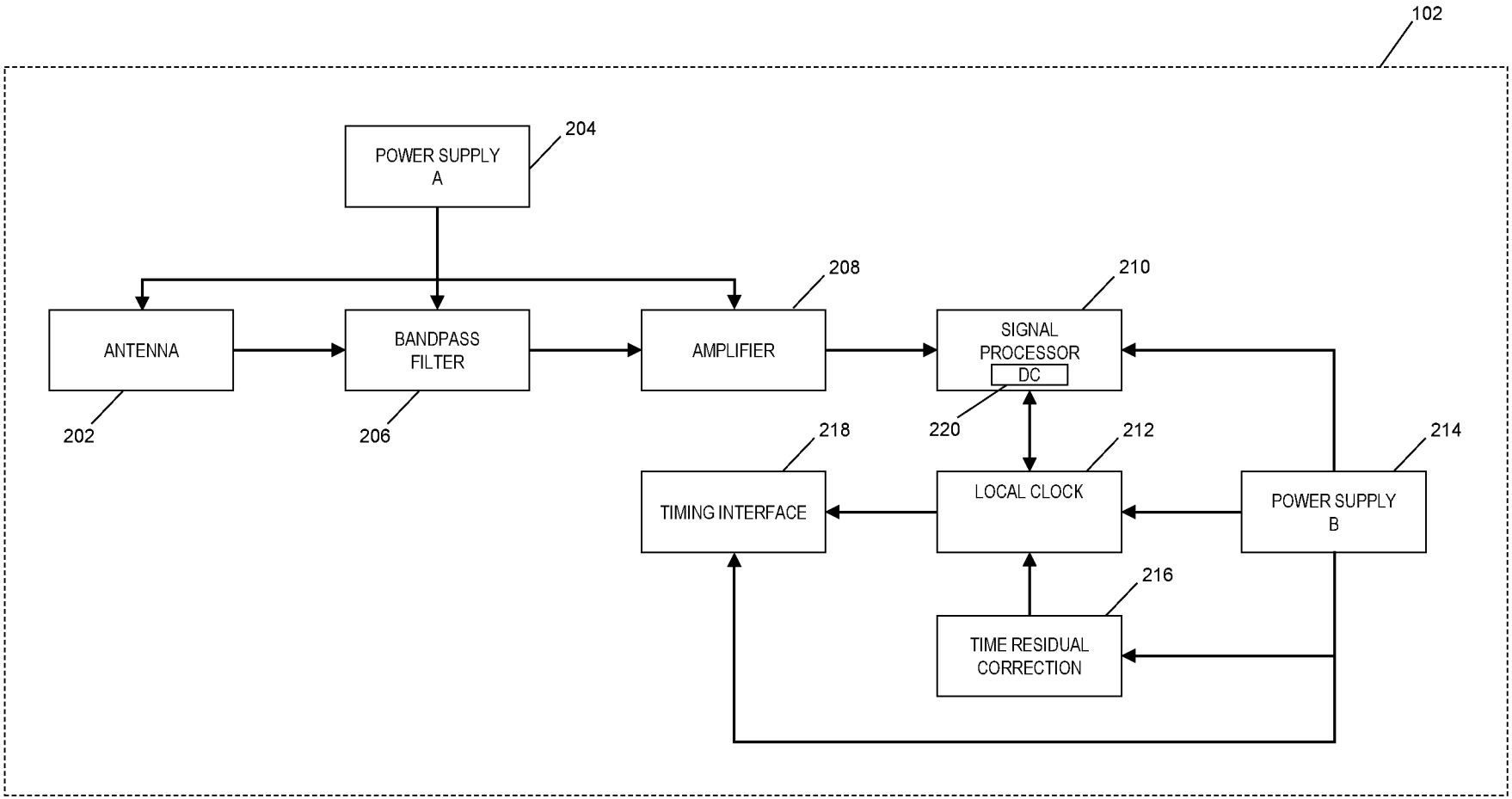
FIG. 2 is a block diagram of a pulsar signal receiver device according to an embodiment of the subject matter described herein.

FIG. 2 depicts a block diagram of an exemplary pulsar signal receiver device (e.g., pulsar signal receiver device 102) according to an embodiment of the subject matter described herein. As shown in FIG. 2, pulsar signal receiver device 102 may comprise hardware and/or software components that are collectively configured to obtain a pulse signal from a pulsar (or PTA) or other celestial object for the purpose of generating a timing synchronization signal. In some embodiments, pulsar signal receiver device 102 may include a pulsar signal antenna 202, a bandpass filter 206, a signal amplifier 208, a signal processor 210, a time residual correction module 216, a local clock 212, and a timing interface module 218. Pulsar signal receiver device 102 may further include a first power supply 204 (e.g., "power supply A") that is utilized to provide electrical power to pulsar signal antenna 202, bandpass filter 206, and signal amplifier 208. Pulsar signal receiver device 102 may further include a second power supply 214 (e.g., "power supply B") that is utilized to provide electrical power to signal processor 210, a time residual correction module 216, local clock 212, and timing interface module 218.

In some embodiments, pulsar signal antenna 202 is used to capture the pulsar signal emitted by a pulsar or other celestial object. Since the radio pulse signal of a pulsar that ultimately arrives at Earth is very weak, pulsar signal antenna 202 may comprise an antenna (or an antenna array) that is adapted to receive the pulse signal via a high signal power concentration configuration. For example, pulsar signal antenna 202 may be embodied as a dish antenna with a diameter (e.g., 6 meters or more) that is sufficient to obtain enough Signal-to-Noise Ratio (SNR) information. Notably, the actual size and scale of pulsar signal antenna 202 is dependent on the selected pulsar (or PTA) and the capabilities of signal amplifier 208 and signal processor 210. While other types of antennas may be used, a parabolic antenna may be desired in order to achieve the best performance. The diameter of the parabolic antenna utilized by the disclosed subject matter can range to several meters to tens of meters. The direction of the antenna should be tuned to point toward the pulsar being observed.

After a pulse signal is captured by pulsar signal antenna 202, the pulse signal is provided to a bandpass filter 206, which includes an analog filter that is configured to extract a desired frequency spectrum as well as eliminate noise. While pulse signals can be found ranging over a wide frequency spectrum, pulsar signal receiver device 102 can be configured to capture pulse signals at or around the Hydrogen line frequency of 1420 megahertz (MHz) by configuring bandpass filter 206 to filter frequencies outside of the Hydrogen line frequency. The Hydrogen line frequency can be ideal for capturing pulse signals since the pulse signal can be more easily differentiated and distinguished from accompanying noise by pulsar signal receiver device 102. Further, the pulse signal captured at 1420 MHz is less likely to be disturbed by other radio signals. In some embodiments, the bandwidth size of bandpass filter 206 in pulsar signal receiver device 102 is configured to be 1 MHz. In some embodiments, bandpass filter 206 may be configured to have a center frequency of 1420 MHz and a passband width of 400 MHz. Further, bandpass filter 206 can be designed as either a one stage filter or a multiple stage filter. To achieve a satisfactory SNR, a bandpass filter designed with multiple stages is preferable.

In some embodiments, bandpass filter 206 is connected to signal amplifier 208. In some embodiments, this connection is realized via a wired cable, such as a shielded coaxial cable. In other embodiments, the connection may be through a wire on printed circuit board (PCB). Notably, signal amplifier 208 can be configured to amplify the pulse signal that has been captured by pulsar signal antenna 202 and filtered by bandpass filter 206. For example, signal amplifier 208 is configured to amplify the magnitude or amplitude of a 1420 MHz signal. More specifically, signal amplifier 208 may be configured to amplify the pulse signal extracted at the desired frequency spectrum (e.g., 1420 MHz). In alternate embodiments, signal amplifier 208 may instead be provisioned with its own internal bandpass filter (as opposed to separate bandpass filter 206) that is configured to filter out the noise from the pulse signal.

Figure 3:
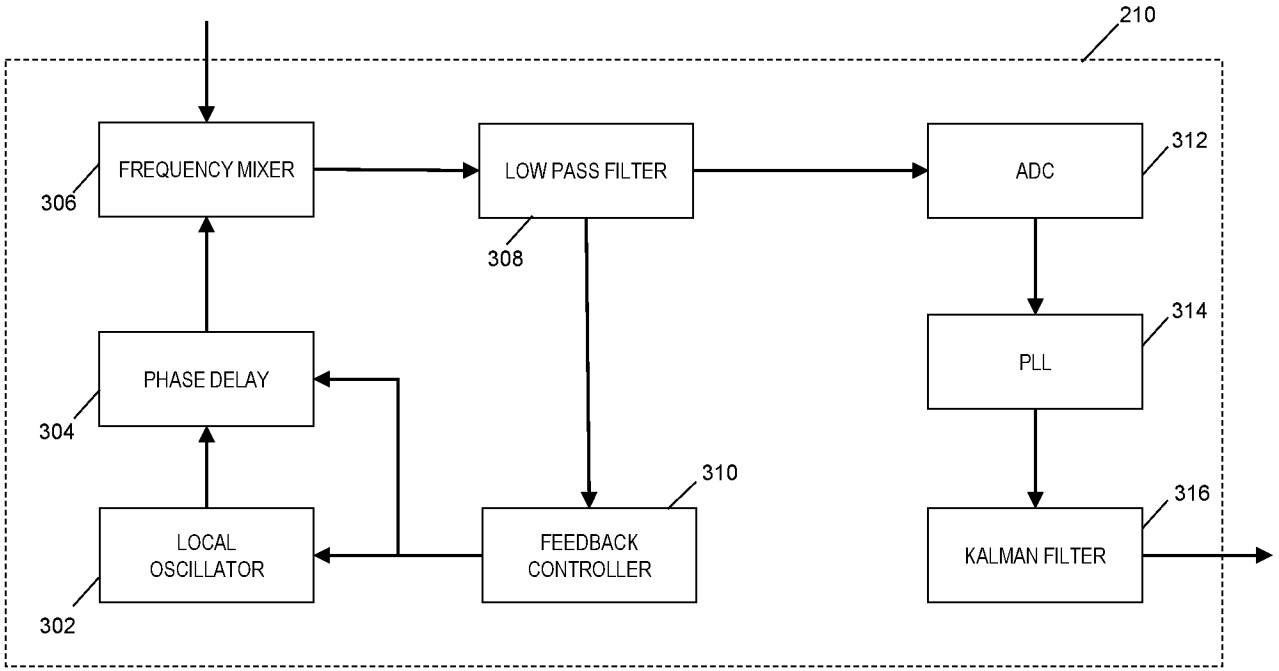
FIG. 3 is a block diagram of a signal processor in a pulsar signal receiver device according to an embodiment of the subject matter described herein.

After being amplified by signal amplifier 208, the pulse signal is forwarded to signal processor 210. In some embodiments, signal processor 210 may include any digital signal processor (DSP) that is configured to extract and/or reshape a pulse signal. For example, signal processor 210 is configured to extract the pulse signal that modulates the amplitude of the 1420 MHz signal. Signal processor 210 is depicted in greater detail in FIG. 3. Specifically, FIG. 3 is a block diagram of a signal processor in a pulsar signal receiver device according to an embodiment of the subject matter described herein. As shown in FIG. 3, signal processor 210 includes a local oscillator 302, a phase delay module 304, a frequency mixer 306, a low pass filter 308, a feedback controller 310, analog to digital converter (ADC) 312, a digital phase-lock loop (PLL) component 314, and a Kalman filter 316.

In some embodiments, local oscillator 302 in signal processor 210 is configured to generate a demodulation signal. For example, local oscillator 302 may be configured to generate a 1420 MHz demodulation signal that can be used to extract the amplitude of an input signal. The generated demodulation signal is then provided to phase delay module 304, which is configured to control the phase delay of the demodulation signal. Afterwards, the phase delayed demodulation signal is fed to frequency mixer 306. Frequency mixer 306 is also configured to receive a pulse signal input from a signal amplifier. In some examples, the pulse signal input is an analog 1420 MHz pulse signal that is output from signal amplifier 208 (as previously shown in FIG. 2). Notably, frequency mixer 306 is configured to "mix" the pulse signal input received from the signal amplifier with the demodulation signal received from the local oscillator 302 via phase delay module 304 (e.g., mix two 1420 MHz signals). In particular, frequency mixer 306 uses the demodulation signal to demodulate the pulse signal input. The resulting demodulated output of frequency mixer 306 comprises two frequency components or parts, which include i) a high frequency component that is the sum of the signal frequencies (e.g., at or around 2840 Mhz) and ii) a low frequency component that is the difference of the signal frequencies (e.g., at or around a zero hertz frequency signal). When the frequency of local oscillator 302 is configured to be equal to the Hydrogen line frequency and the phase angle of local oscillator 302 is equal to the phase angle of the input pulse signal, then the low frequency component is a direct current (DC) component and its magnitude is equal to the multiplication product of the amplitude of the pulse signal input and the amplitude of the demodulation signal produced by local oscillator 302. The two frequency components of frequency mixer 306 are subsequently fed into a low pass filter 308, which is used to filter out the high frequency component and retain the low frequency component of the signal output from frequency mixer 306. As the amplitude of the demodulation signal is constant, the DC component is proportional to the magnitude of the input pulse signal (e.g. 1420 MHz signal).

At this stage, low pass filter 308 provides the low frequency component to both a feedback controller 310 and an analog-to-digital converter (ADC) 312. In some embodiments, feedback controller 310 can be used to tune the frequency and phase angle of local oscillator 302. For example, feedback controller 310 is used to control the frequency of local oscillator 302 and control the phase through phase delay module 304. By controlling local oscillator 302 and phase delay module 304 in this manner, feedback controller 310 is able to maximize the later output of low pass filter 308. The control of feedback controller 310 is conducted by small steps. The output of low pass filter 308 achieves a maximum value when the frequency and phase output of local oscillator 302 is equal to the pulse signal input into frequency mixer 306 from the signal amplifier. When feedback controller 310 achieves a larger amplitude from low pass filter 308 by tuning the phase delay of phase delay module 304 and the frequency of local oscillator 302, feedback controller 310 will continue to tune them in this direction until the amplitude no longer increases. If the current tuning direction decreases the output from low pass filter 308, feedback controller 310 may be configured to tune in the other direction. For example, if increasing the frequency decreases the amplitude, feedback controller 310 can attempt to decrease the frequency. When both increasing and decreasing the frequency and phase angle decreases the amplitude, the maximum value of amplitude is achieved, meaning the frequency and phase angle fed from phase delay module 304 to frequency mixer 306 is the same as the frequency and phase angle of the pulse signal from the signal amplifier.

In some embodiments, the output of low pass filter 308 is proportional to the amplitude of the frequency in the input pulse signal, e.g., the 1420 MHz pulse signal. The analog output is fed into ADC 312 and subsequently converted into a digital signal. Notably, the pulse signal (originating from pulsar 104 as shown in FIG. 1) is embedded in the digital signal output, which also contains noise. After conducting the analog-to-digital conversion, ADC 312 directs the signal to digital phase-lock loop (PLL) component 314. Notably, PLL component 314 can be configured to extract the pulse signal from the noise and convert the pulse signal into a square waveform. In some embodiments, the square waveform generated by PLL component 314 provides a 'sharp' rising signal edge (as opposed to less pronounced slopes that are inherent with the presence of noise) that is easily detected and devoid of errors and/or jitters. The resulting square waveform is then fed through a Kalman filter 316 that eliminates the white noise embedded in the time interval of the pulse signal and minimizes the square of local clock frequency deviation from the pulse signal. Accordingly, the output of Kalman filter 316 is a digital pulse signal (without any noise) that is processed by signal processor 210 depicted in FIG. 2.

Returning to FIG. 2, the digital pulse signal output of the Kalman filter in signal processor 210 is used to discipline or configure a local clock 212 in the pulsar signal receiver device 102. In some embodiments, local clock 212 provides time information and a pulse per second (PPS) signal. Notably, the PPS signal is a timing synchronization signal that is ultimately utilized by local and remote power system devices (e.g., devices 110, 112, 114 shown in FIG. 1). In some embodiments, the aforementioned time information is included in the timing synchronization signal and can include year, month, day, hour, minute, and/or second information (e.g., time stamp data).

In some embodiments, a discipline controller 220 in signal processor 210 is configured to monitor the time difference between an input signal (e.g., the digital pulse signal from Kalman filter) and the internal time maintained by local clock 212 (e.g., local clock 212 sends an output time to discipline controller 220). In some embodiments, discipline controller 220 is a voltage controller that is able to increase or decrease (e.g., tune) the frequency of the local clock by using a discipline controller 220 to send a control voltage signal to local clock 212. The time period of the digital pulse signal input is preset in discipline controller 220. Notably, discipline controller 220 can be set to know the time period of both the digital pulse signal input and the time period of the local clock. The time period of the digital pulse signal input is typically an "integer times" larger than the period of the local clock. A digital counter in discipline controller 220 may then be preset with this period ratio, so the digital counter counts the periods of the local clock and triggers the comparison of the digital pulse signal against the corresponding time signal from the local clock. Each time a rising edge of the input signal arrives, a time interval as determined with respect to the last rising edge is calculated by local clock 212 (e.g., the time interval is equal to the amount of time expired between the arrival of the two rising edges). This time interval is then compared with the aforementioned preset or predefined time period. Notably, discipline controller 220 calculates the time difference that results from this comparison. Notably, the calculated time difference represents the time error of local clock 212. The determined time error can then be used by discipline controller 220 to correct or discipline local clock 212, thereby enabling local clock 212 to produce an accurate time (e.g., an accurate time "output").

In some embodiments, local clock 212 and/or discipline controller 220 is configured to provide the accurate time output to the ADC (e.g., ADC 312) in signal processor 210. Notably, the ADC is able to utilize the accurate time output to ensure that the sampling rate used by the ADC is accurate. This can be achieved by feeding the output of local clock 212 into a system clock input port of ADC 312. In some embodiments, a frequency divider or multiplier is needed to transfer the frequency output of local clock 212 into the acceptable frequency of ADC 312 if needed. In some embodiments, the signal fed from local clock 212 to ADC 312 constitutes a square wave with an accurate frequency (e.g., ranging between several kHz to MHz). In contrast, the timing signal being fed to timing interface module 218 includes the time synchronization pulse (e.g., pulse per second or several pulses per second) and the timing information (e.g., year, month, day, hour, minute, and/or second data).

External factors existing in the Earth's atmosphere and beyond may alter the measured pulse periods. Such factors may include the change of interstellar medium dispersion and/or the ionospheric and tropospheric effects present around the planet. These factors may cause a transmission delay of the pulse signal. Changes in the transmission delay can be detected by inconsistent pulse periods that are measured. Notably, such inconsistencies can cause errors in the pulsar timing system. In some embodiments, astronomical observations can be used to build models that estimate this change of transmission delay. In some embodiments, the estimated change of transmission delay can be used as a modifier to correct the input of discipline controller 220 in the local clock 212, so as to provide an accurate reference for local clock discipline and/or correction. A correction factor (modifier) may be used by discipline controller 220 to tune the control voltage that discipline controller 220 applies to a frequency control port of local clock 212. In such an embodiment, the control voltage output by discipline controller 220 depends on not only the time difference between local clock and the pulsar signal, but also the correction factor.

In some embodiments, local clock 212 also includes a synchronization port, which is used to synchronize the local clock to the desired time reference, such as Coordinated Universal Time (UTC). This is because that the timing of the local clock, although disciplined by the pulsar which provides an accurate and stable time interval, is not aligned to other timing systems, such as UTC which is nearly used by all timing devices at present. By synchronizing the local clock to the desired time reference, the timing generated by this pulsar system can be used to replace other timing sources. To achieve this, the GPS or other accurate timing source can be used as the synchronization input. The time offset between the reference and the local clock is obtained and added to the local clock output, so that the local clock is synchronized to the desired time reference.

In some embodiments, the accurate time output of local clock 212 is fed into a timing interface module 218. Timing interface module 218 is configured to provide a driving capability so pulsar signal receiver device 102 can produce a timing synchronization signal (e.g., a PPS signal) with a desired voltage level, format, and level of accuracy. In some embodiments, the desired voltage level, format, and level/degree of accuracy can be predefined using timing interface module 218 per the use requirements of local power system device 110 and/or time distribution system server 108. In some embodiments, the timing synchronization signal is output from timing interface module 218 to local power system device 110 and/or time distribution system server 108 (as shown in FIG. 1).

Returning to FIG. 1, system 100 further includes timing distribution system server 108. As indicated above, timing distribution system server 108 can be configured to distribute the timing synchronization signal (e.g., a PPS signal) generated by pulsar signal receiver device 102 to remote power system devices 112-114 (which need a timing synchronization signal to operate properly). For remote locations such as power substations, system 100 may not be conducive or amenable for accommodating the installation of a local pulsar signal receiver device. Moreover, it may not be cost-effective for each of remote power system devices 112-114 to be installed with its own pulsar signal receiver device. As such, timing distribution system server 108 is configured to provide an accurate and timing synchronization signal from an available and/or centralized pulsar signal receiver device without necessitating the installation of a pulsar signal receiver device at the separate remote locations.

In some embodiments, the timing distribution system may include, but not limited to, i) a network timing distribution system, such as a wide area precision time protocol (PTP) system, ii) a radio broadcasting system, such as an eLoran system, and the like. The selection and design of a timing distribution system largely depends on the distance, budget, device interface, and the requirement of the timing synchronization signal quality.

Figure 4:
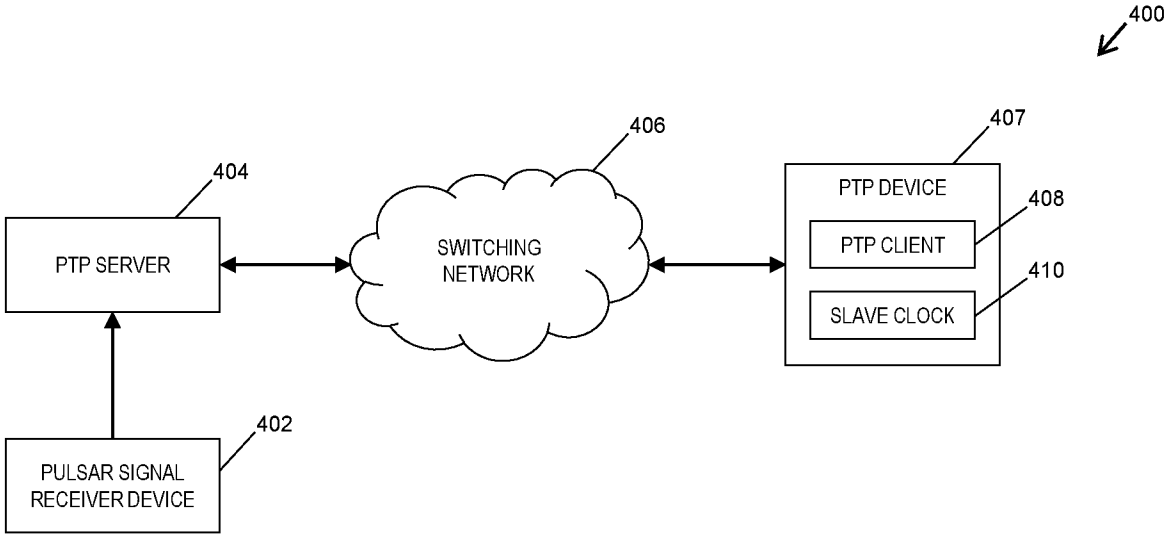
FIG. 4 is a block diagram of a precision timing protocol (PTP) timing distribution system according to an embodiment of the subject matter described herein.

FIG. 4 depicts a block diagram of an exemplary timing distribution system according to an embodiment of the subject matter described herein. For example, FIG. 4 depicts a PTP timing distribution system 400 that includes a pulsar signal receiver device 402, a PTP server 404, a switching network 406, a remote PTP device 407 that includes a PTP client 408, and a local slave clock 410. In some embodiments, pulsar signal receiver device 402 is used as a master clock for the PTP timing distribution system 400. Pulsar signal receiver device 402 is communicatively connected with a PTP server 404 that are collectively functioning as a grandmaster. In some embodiments, the grandmaster is a root timing reference of the PTP system and is responsible for transmitting synchronization information to the local slave clocks. PTP server 404 can be configured to generate PTP messages according to the timing synchronization signal that is generated by pulsar signal receiver device 402. In some embodiments, the timing synchronization signal generated by pulsar signal receiver device 402 complies with the PTP standard IEEE 1588. In some embodiments, an eLoran sever and eLoran system can be used in lieu of a PTP server and PTP timing distribution system, respectively.

After receiving the PPS signal, PTP server 404 is configured to generate and transmit PTP messages through switching network 406 to remote PTP device(s) 407 (e.g., remote substations). In some embodiments, PTP server 404 uses the time information and synchronization signal from pulsar signal receiver device 402 to generate the PTP message. The message format follows the specific version PTP protocol being used in the disclosed subject matter, and includes but not limited to message header, target port, message type, time stamp. Upon receiving the PTP signal, PTP client 408 utilizes the timing synchronization signal to correct any timing error of its local slave clock 410 (e.g., a boundary clock). In some embodiments, local slave clock 410 has an internal communications connection to PTP client 408. In some alternate embodiments, local slave clock 410 is separate from remote device 407 and has an external connection to PTP client 408. Once local slave clock 410 is corrected, local slave clock 410 is able to provide a synchronized and accurate timing synchronization signal to power system devices positioned at the present remote location.

Figure 5:
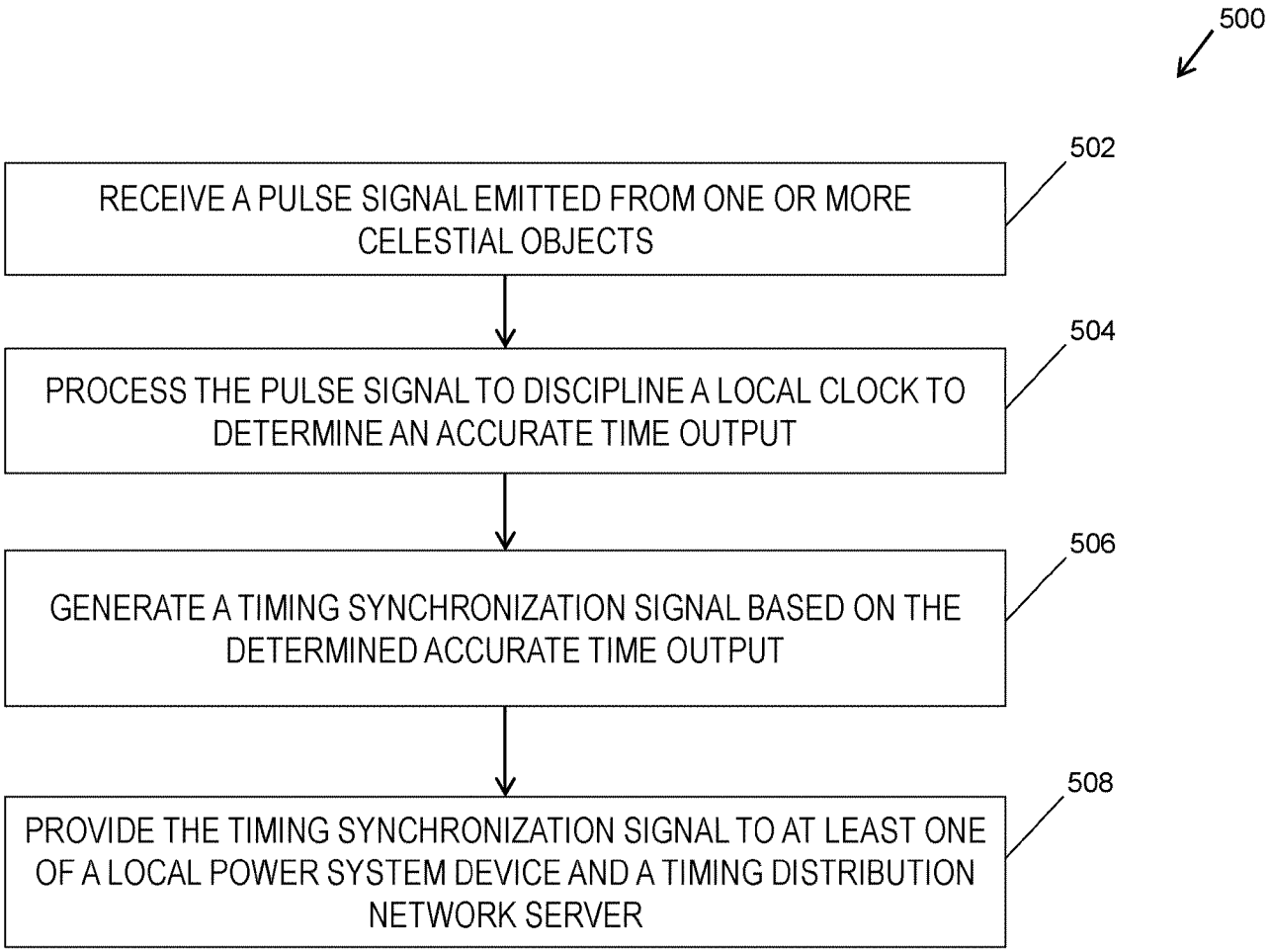
FIG. 5 is a flow chart of a method providing timing synchronization signals using a pulsar signal receiver device according to an embodiment of the subject matter described herein.

FIG. 5 is a flow chart illustrating an exemplary method 500 for utilizing a pulsar signal based timing synchronization system according to an embodiment of the subject matter described herein. In some embodiments, method 500 depicted in FIG. 5 is an algorithm stored in a memory of pulsar signal receiver device that when executed by a hardware processor (of the pulsar signal receiver device) performs one or more of blocks 502-508.

In block 502, a pulse signal emitted from one or more celestial objects is receive by a pulsar signal receiver device. In some embodiments, the pulsar signal antenna of the pulsar signal receiver device captures a radio pulse signal originating from a pulsar or pulsar timing array.

In block 504, the pulse signal is processed by the pulsar signal receiver device to discipline a local clock to determine an accurate time output. In some embodiments, the pulsar signal receiver device filters and amplifies the captured pulse signal. In addition, a signal processor in the pulsar signal receiver device is further configured to conduct further filtering, digital converting, and waveform shaping to the pulse signal in order to produce an output that is used to discipline or adjust a local clock in the pulsar signal receiver device.

In block 506, a timing synchronization signal based on the determined accurate time output is generated by the pulsar signal receiver device. In some embodiments, a timing interface module use the accurate time output from the local clock to produce a timing synchronization signal.

In block 508, the timing synchronization signal is provided by the pulsar signal receiver device to at least one of a local power system device and a timing distribution network server. In some embodiments, the timing interface module in the pulsar signal receiver device directs the timing synchronization signal to a local power system device and a timing distribution network server, which in turn distributes the timing synchronization signal to one or more remote power system devices. The power system devices may then utilize the timing synchronization signal to timely execute power system synchronous monitoring, protection, and control functions in the electrical power grid system.

The embodiments disclosed herein are provided only by way of example and are not to be used in any way to limit the scope of the subject matter disclosed herein. As such, it will be understood that various details of the presently disclosed subject matter may be changed without departing from the scope of the presently disclosed subject matter. The foregoing description is for the purpose of illustration only, and not for the purpose of limitation.

What is claimed is:

1. A method comprising:

receiving, by a pulsar signal receiver device, a pulse signal emitted from one or more celestial objects;

processing, by the pulsar signal receiver device, the pulse signal to discipline a local clock to determine an accurate time output;

generating, by the pulsar signal receiver device, a timing synchronization signal based on the determined accurate time output, wherein the pulsar signal receiver device further includes a timing interface configured to convert the accurate time output into the timing synchronization signal that includes a predefined driving capability, voltage level, format, and level of accuracy; and providing, by the pulsar signal receiver device, the timing synchronization signal to at least one of a local power system device and a timing distribution network server.

2. The method of claim 1 further comprising distributing, by the time distribution network server, the timing synchronization signal to one or more remote power system devices.

3. The method of claim 2 wherein at least one of the local power system device and the remote power system devices utilizes the timing synchronization signal to conduct power system synchronous monitoring, protection, and/or control functions.

4. The method of claim 1 wherein the one or more celestial objects include a plurality of pulsars or a pulsar timing array (PTA).

5. The method of claim 1 wherein the pulsar signal receiver device includes a time residual correction module configured to correct a timing error that is associated with the pulse signal and is attributed to interstellar medium dispersion, ionospheric effects, and tropospheric effects.

6. The method of claim 5 wherein the local clock is disciplined by a signal processor in the pulsar signal receiver device and corrected by the time residual correction module.

7. The method of claim 1 wherein the timing synchronization signal is generated by the local clock or a timing interface module in the pulsar signal receiver device.

8. The method of claim 1 wherein the pulsar signal receiver device further comprises a bandpass filter configured to extract a desired frequency spectrum of the pulse signal and a signal amplifier configured to amplify the pulse signal in the desired frequency spectrum.

9. The method of claim 1 wherein the time distribution network server is a precision timing protocol (PTP) server or an eLoran server.

10. A system comprising:

a timing distribution network server that is communicatively connected to a plurality of remote power system devices; and a pulsar signal receiver device configured to receive a pulse signal emitted from one or more celestial objects, process the pulse signal to discipline a local clock to determine an accurate time output, generate a timing synchronization signal based on the determined accurate time output, and to provide the timing synchronization signal to the timing distribution network server, wherein the pulsar signal receiver device further includes a timing interface configured to convert the accurate time output into the timing synchronization signal that includes a predefined driving capability, voltage level, format, and level of accuracy.

11. The system of claim 10 wherein the time distribution network server is configured to distribute the timing synchronization signal to one or more remote power system devices.

12. The system of claim 11 wherein the pulsar signal receiver device is configured to provide the timing synchronization signal to at least one local power system device.

13. The system of claim 12 wherein each of the at least one local power system device and the remote power system devices utilizes the timing synchronization signal to conduct power system synchronous monitoring, protection, and/or control functions.

14. The system of claim 10 wherein the one or more celestial objects include a plurality of pulsars or a pulsar timing array (PTA).

15. The system of claim 10 wherein the pulsar signal receiver device includes a time residual correction module configured to correct a timing error that is associated with the pulse signal and is attributed to interstellar medium dispersion, ionospheric effects, and tropospheric effects.

16. The system of claim 15 wherein the local clock is disciplined by a signal processor in the pulsar signal receiver device and corrected by the time residual correction module.

17. The system of claim 10 wherein the timing synchronization signal is generated by the local clock or a timing interface module in the pulsar signal receiver device.

18. The system of claim 10 wherein the pulsar signal receiver device further comprises a bandpass filter configured to extract a desired frequency spectrum of the pulse signal and a signal amplifier configured to amplify the pulse signal in the desired frequency spectrum.

* * * * *